US006271190B1

(12) United States Patent
Boskamp et al.

(10) Patent No.: US 6,271,190 B1
(45) Date of Patent: Aug. 7, 2001

(54) CLEANING COMPOSITIONS

(75) Inventors: Jelles Vincent Boskamp; Paulus Jacobus Loomans, both of Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/590,314

(22) Filed: Jun. 8, 2000

(30) Foreign Application Priority Data

Jun. 10, 1999 (GB) ..... 9913551

(51) Int. Cl.[7] ..... C11D 3/382; C11D 7/44; C11D 17/00

(52) U.S. Cl. ..... 510/446; 510/224; 510/294; 510/298; 510/344; 510/462

(58) Field of Search ..... 510/224, 294, 510/298, 446, 344, 462

(56) References Cited

U.S. PATENT DOCUMENTS

| | | | | |
|---|---|---|---|---|
| 2,560,097 | | 7/1951 | Emerson et al. | 252/89 |
| 2,622,047 | * | 12/1952 | Ayers | 134/7 |
| 3,563,693 | * | 2/1971 | Cohen | 8/142 |
| 4,013,581 | | 3/1977 | Huber | 252/186 |
| 4,056,400 | * | 11/1977 | Diamantoglou et al. | 106/62 |
| 4,557,854 | * | 12/1985 | Plueddemann | 510/344 |
| 5,104,584 | * | 4/1992 | Kong | 510/309 |
| 5,900,395 | * | 5/1999 | Nicholson et al. | 510/224 |
| 6,083,621 | * | 7/2000 | Sugimoto | 428/378 |

FOREIGN PATENT DOCUMENTS

| | | | |
|---|---|---|---|
| 1068849 | * | 2/1993 | (CN) . |
| 0 379 599 | | 8/1990 | (EP) . |
| 0 711 827 | | 5/1996 | (EP) . |
| 0 838 519 | | 4/1998 | (EP) . |
| 911204 | | 11/1962 | (GB) . |
| 08231986 | * | 9/1996 | (JP) . |
| 09123184 | * | 5/1997 | (JP) . |
| 90/02165 | | 3/1990 | (WO) . |
| 98/40462 | | 9/1998 | (WO) . |
| 98/40463 | | 9/1998 | (WO) . |
| 98/40462 | | 12/1998 | (WO) . |
| 98/55575 | | 12/1998 | (WO) . |
| 98/55582 | | 12/1998 | (WO) . |
| 98/55583 | | 12/1998 | (WO) . |
| 98/55590 | | 12/1998 | (WO) . |

OTHER PUBLICATIONS

Derwent Abstract on NL 1005417C published Sep. 7, 1998.

* cited by examiner

*Primary Examiner*—Lorna M. Douyon
(74) *Attorney, Agent, or Firm*—Rimma Mitelman

(57) ABSTRACT

A tablet of compacted particulate cleaning composition containing at least one cleaning ingredient which is an organic surfactant, a water softening agent or a bleach, wherein the tablet or a discrete region of the tablet contains water-insoluble, water-swellable disintegration-promoting particles which are cellulosic material from a plant source other than timber. The invention also provides a tablet of compacted particulate cleaning composition containing at least one cleaning ingredient which is an organic surfactant, a water softening agent or a bleach, wherein the tablet or a discrete region of the tablet contains disintegration-promoting particles of coconut husk material. A process to produce the tablets is also provide which comprises mixing the water-insoluble, water-swellable disintegration-promoting materials with other particulate ingredients so as to form a particulate cleaning composition and compacting a quantity of the particulate composition in a mould so that it forms a tablet or a region of a tablet. The tablets provide disintegration characteristics combined with satisfactory strength.

18 Claims, No Drawings

CLEANING COMPOSITIONS

This invention relates to cleaning compositions in the form of tablets. These tablets are intended to disintegrate when placed in water and thus are intended to be consumed in a single use. The tablets may be suitable for use in machine dishwashing, the washing of fabrics or other cleaning tasks.

Detergent compositions in tablet form and intended for fabric washing have been described in a number of documents including, for example, GB-A-911204 (Unilever), WO 90/02165 (Henkel) and EP-A-711827 (Unilever) and are now sold commercially. Tablets containing bleach for use as an additive to a fabric washing liquor have been disclosed in U.S. Pat. No. 4,013,581 (Huber/Procter and Gamble). Tablets containing a water softening agent, for use as an additive in cleaning, are sold commercially and are one form of tablet disclosed in EP-A-838519 (Unilever). Tablets of composition suitable for machine dishwashing are sold commercially. Tablets have several advantages over powdered products: they do not require measuring and are thus easier to handle and dispense into the washload, and they are more compact, hence facilitating more economical storage.

Tablets of a cleaning composition are generally made by compressing or compacting a composition in particulate form. Although it is desirable that tablets have adequate strength when dry, yet disperse and dissolve quickly when brought into contact with water, it can be difficult to obtain both properties together. Tablets formed using a low compaction pressure tend to crumble and disintegrate on handling and packing; while more forcefully compacted tablets may be sufficiently cohesive but then fail to disintegrate or disperse to an adequate extent in the wash. Tableting will often be carried out with enough pressure to achieve a compromise between these desirable but antagonistic properties. However, it remains desirable to improve one or other of these properties without detriment to the other so as to improve the overall compromise.

If a tablet contains organic surfactant, this functions as a binder, plasticising the tablet. However, it can also retard disintegration of the tablet by forming a viscous gel when the tablet comes into contact with water. Thus, the presence of surfactant can make it more difficult to achieve both good strength and speed of disintegration: the problem has proved especially acute with tablets formed by compressing powders containing surfactant and built with insoluble detergency builder such as sodium aluminosilicate (zeolite).

The use of crude cellulosic particles such as sawdust or woodflour was suggested many years ago in U.S. Pat. No. 2,560,097, but in the context of one-use tablets for handwashing where the material serves as a filler and the tablets were disintegrated in use by handling.

It is known to include materials whose function is to enhance disintegration of tablets when placed in wash water. For example, our EP-A-838519 mentioned above teaches the use of sodium acetate trihydrate for this purpose.

A number of documents have taught that the disintegration of tablets of cleaning composition can be accelerated by incorporating in the tablet a quantity of a water-insoluble but water-swellable polymeric material. Such documents include WO 98/40462, 98/40463, 98/55575, 98/55582 and 98/55583.

These documents disclose the use of materials derived from timber. WO 98/40462 mentions the use of a material known in the papermaking industry as "Thermomechanical pulp". Fibres obtained from timber by mechanical processing combined with dispersion in water generally contain 35% or more of cellulose and 30% or less of lignin.

Cellulose fibres may be chemically treated to remove this lignin as is done when making high quality white paper. In the papermaking industry the resulting purified fibres are referred to a "chemical fibres".

We have now found that a good speed of tablet disintegration, combined with satisfactory strength, can be achieved through use of cellulosic material which does not come from the wood of trees.

So, according to a first aspect of this invention, there is provided a tablet of compacted particulate cleaning composition containing at least one cleaning ingredient which is an organic surfactant, a water softening agent or a bleach, wherein the tablet or a discrete region of the tablet contains water-insoluble, water-swellable disintegration-promoting particles which are cellulose-containing material from a plant source other than timber.

A number of plant sources other than timber have been recognised as sources of natural fibre useful for making textiles (which may be coarse textiles such as sacking), rope or twine. These include such plants as agave which is a source of sisal, jute, flax and hemp plants which are sources of fibres with the same names, and the ceiba tree whose seed capsules yield kapok. Thus it is envisaged that the disintegration-promoting particles will be particles of a cellulose-containing fibrous material originating from a plant source other than timber. This may be the fruit of a plant or the stem of a plant other than a tree. These materials will generally also include lignin and thus can be termed "lignocellulosic".

A preferred material to be employed in this invention is particles of coconut husk material, sometimes known as coir.

Consequently, in a second aspect this invention provides a tablet of compacted particulate cleaning composition containing at least one cleaning ingredient which is an organic surfactant, a water softening agent or a bleach, wherein the tablet or a discrete region of the tablet contains disintegration-promoting particles of coconut husk material, which is of course water-insoluble. We have discovered that is it strongly water-swellable.

This invention is particularly applicable when the tablets contain both surfactant and detergency builder, as in tablets for fabric washing.

Forms of this invention, preferred and optional features, and materials which may be used, will now be discussed in greater detail.

Discrete Regions/Whole Tablets

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each of which is a matrix of particles derived by compaction from a particulate composition. In a heterogenous tablet according to the present invention, each discrete region of the tablet will preferably have a mass of at least 3 gm.

In a heterogeneous tablet, at least one of the discrete regions contains the said swellable disintegration-promoting particles.

There are a number of possibilities concerning heterogenous tablets. Water-swellable material may or may not be included in every region of a heterogenous tablet, even though the regions differ from each other in some other feature of their composition. Thus the water-swellable material may be present at different concentrations in different tablet regions; it may be present in one region and absent from another; or it may be present at equal concentration in every region of the tablet.

Coconut Husk Material

Coconuts, from the tree *Cocos nucifera* have a fibrous husk (more correctly "mesocarp") which surrounds the hard shell.

It is conventional to separate the fibres from this husk and utilise them as a coarse textile or rope material termed "coir". The residue after removal of the fibres can be used in horticulture as a substitute for peat.

For this invention the husk material which is used may be fibres from ripe or immature coconuts—the latter give paler fibres. Alternatively the material may be a husk residue which is left after the removal of at least some fibres. In either case the material is comminuted as necessary, e.g. milled, to a suitable particle size.

The particles may have a mean size, before contact with water, in a range from 250 to 1,500 micrometers, more preferably 400 up to 1,500 micrometers. The mean particle size may be in a range from 250 or 400 up to 1,100 micrometers. Particularly preferred is a mean particle size in a range from 700 to 1,000 micrometers. It is desirable that all particles larger than 2 mm (2,000 micrometers) are removed, e.g. by sieving.

If desired, this coconut-derived material may be subjected to a bleaching treatment to lighten its colour. It is a feature of coconut husk material that it contains a high proportion of lignin as well as some cellulose. Typically it contains lignin in an amount which is at least 40% of its overall weight, although this might be reduced in the course of any bleaching treatment, for instance to at least 30% or at least 35% by weight lignin. The amount of lignin may exceed the amount of cellulose. In natural materials, lignin is known to decrease the permeation of water across cell walls, suggesting that the presence of lignin might restrict particle swelling.

The material may be mixed with a small quantity of surfactant (perhaps in amount from 0.01 to 1% of the water-swellable particles) so that these particles do not float on the surface of the wash liquor after the disintegration of a tablet containing them.

Analogously to the above, if the water-swellable disintegrant material comes from another plant source, it may be provided by the plant fibres (as might be used for textile or rope making) comminuted to a particle size as discussed above, or it may be provided by residues of the fibrous material after the separation of longer fibres.

Surfactant Compounds

Compositions which are compacted to form tablets or tablet regions of this invention may contain one or more organic detergent surfactants. In a fabric washing composition, these preferably provide from 5 to 50% by weight of the overall tablet composition, more preferably from 8 or 9% by weight of the overall composition up to 40% or 50% by weight. Surfactant may be anionic (soap or non-soap), cationic, zwitterionic, amphoteric, nonionic or a combination of these. For other types of tablets, e.g. machine dishwashing tablets, the surfactants may provide from 0 to 5% by weight of the tablet or a discrete region thereof.

Anionic surfactant may be present in an amount from 0.5 to 50% by weight, preferably from 2% or 4% up to 30% or 40% by weight of the tablet composition.

In a machine dishwashing composition, organic surfactant is likely to constitute from 0.5 to 8%, more likely from 0.5 to 4.5% of the overall composition and is likely to consist of nonionic surfact, either alone or in a mixture with anionic surfactant.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates. Primary alkyl sulphate having the formula;

$$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant. Linear alkyl benzene sulphonate of the formula

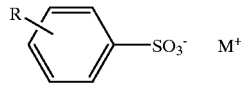

where R is linear alkyl of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof will be the desired anionic surfactant and may provide 75 to 100 wt % of any anionic non-soap surfactant in the composition.

In some forms of this invention the amount of non-soap anionic surfactant lies in a range from 5 to 20 or 25 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40%, better 4 or 5 to 30% by weight of the comoosition. Many nonionic surfactants are liquids. These may be absorbed onto particles of the composition, prior to compaction into tablets.

Amphoteric surfactants which may be used jointly with anionic or nonionic surfactants or both include amphopropionates of the formula:

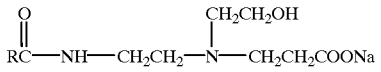

where RCO is a acyl group of 8 to 18 carbon atoms, especially coconut acyl.

The category of amphoteric surfactants also includes amine oxides and also zwitterionic surfactants, notably betaines of the general formula

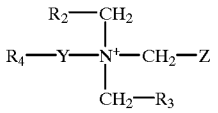

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$, is $CH_2$ or of the form $CONHCH_2CH_2CH_2$ (amidopropyl betaine); Z is either a $COO^-$ (carboxybetaine), or of the form $CHOHCH_2SO_3$— (sulfobetaine or hydroxy sultaine).

Another example of amphoteric surfactant is amine oxide of the formula

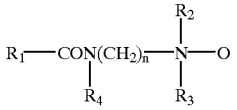

where $R_1$ is $C_{10}$ to $C_{20}$ alkyl or alkenyl $R_2$, $R_3$ and $R_4$ are each hydrogen or $C_1$ to $C_4$ alkyl while n is from 1 to 5.

Cationic surfactants may possibly be used. These frequently have a quaternised nitrogen atom in a polar head group and an attached hydrocarbon group of sufficient length to be hydrophobic. A general formula for one category of cationic surfactants is

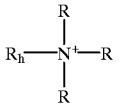

where each R independently denotes an alkyl group or hydroxyalkyl group of 1 to 3 carbon atoms and $R_h$ denotes an aromatic, aliphatic or mixed aromatic and aliphatic group of 6 to 24 carbon atoms, preferably an alkyl or alkenyl group of 8 to 22 carbon atoms.

The amount of amphoteric surfactant, if any, may possibly be from 3% to 20 or 30% by weight of the tablet or region of a tablet; the amount of cationic surfactant, if any, may possibly be from 1% to 10 or 20% by weight of the tablet or region of a tablet.

If the particles of water-swellable material are to be mixed with surfactant, so that they do not end up floating on top of the wash liquor, it is suitable for this purpose to spray them with a liquid anionic surfactant which as Aerosil OT, which is the sodium salt of sulphosuccinic acid by (2-ethylhexyl) ester.

Such a surfactant may be sprayed on in a quantity which is from 0.01 to 10% of the weight of the water-swellable particles, preferably from 0.01 to 0.5% of their weight.

Water-Softening Agent

A composition which is compacted to form tablets or tablet regions may contain a so-called water-softening agent which serves to remove or sequester calcium and/or magnesium ions in the water. In the context of a detergent composition containing organic surfactant, a water-softening agent is more usually referred to as a detergency builder.

When a water-softening agent is present, the amount of it is likely to lie in a broad range from 5 better 10 or 15 wt % up to 98% of the tablet composition. In detergent tablets the amount is likely to be from 15 to 80%, more usually 15 to 50 or 60% by weight of the tablet.

Water-softening agents may be provided wholly by water soluble materials, or may be provided in large part or even entirely by water-insoluble material with water-softening properties.

Alkali metal aluminosilicates are strongly favoured as environmentally acceptable water-insoluble softening agents (detergency builders) for fabric washing. Alkali metal (preferably sodium) aluminosilicates may be either crystalline or amorphous or mixtures thereof, having the general formula:

$$0.8\text{–}1.5\ Na_2O.Al_2O_3.0.8\text{–}6\ SiO_2.xH_2O$$

These materials contain some bound water (indicated as $xH_2O$) and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange materials are described, for example, in GB 1429143 (Procter & Gamble). The preferred sodium aluminosilicates of this type are the well known commercially available zeolites A and X, the newer zeolite P described and claimed in EP 384070 (Unilever) and mixtures thereof. This form of zeolite P is also referred to as "zeolite MAP". One commercial form of it is denoted "zeolite A24".

Conceivably a water-insoluble water-softener (detergency builder) could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

The category of water-soluble phosphorus-containing inorganic softeners includes the alkali-metal orthophosphates, metaphosphates, pyrophosphates and polyphosphates. Specific examples of inorganic phosphate detergency builders include sodium and potassium tripolyphosphates, orthophosphates and hexametaphosphates.

Non-phosphorus water-soluble water-softening agents may be organic or inorganic. Inorganics that may be present include alkali metal (generally sodium) carbonate; while organics include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates. Nitrilotriacetates, such as sodium nitrilotriacetate may also be present.

Tablet compositions preferably include polycarboxylate polymers, more especially polyacrylates and acrylic/maleic copolymers which have some function as water-softening agents and also inhibit unwanted deposition onto fabric from the wash liquor.

Bleach System

Tableted compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 85% by weight of the composition eg. from 25 to 85%. If the tablet contains surfactant and detergency builder, the amount of peroxygen compound bleach is unlikely to exceed 25% of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Water-Soluble Disintegration-Promoting Particles

A tablet or a region of a tablet may contain water-soluble particles to promote disintegration, in addition to the water-swellable, insoluble particles required by this invention.

Such soluble particles typically contain at least 40% (of their own weight) of one or more materials selected from compounds with a water-solubility exceeding 50 grams per 100 grams water, phase I sodium tripolyphosphate, sodium tripolyphosphate which is partially hydrated so as to contain water of hydration in an amount which is at least 0.5% by weight of the sodium tripolyphosphate in the particles.

As will be explained further below, these disintegration-promoting particles can also contain other forms of tripolyphosphate or other salts within the balance of their composition.

If the material in such water-soluble disintegration-promoting particles can function as a detergency builder, (as is the case with sodium tripolyphosphate) them of course it contributes to the total quantity of detergency builder in the tablet composition.

The quantity of water-soluble disintegration-promoting particles may be from 0.1 to 30%, for example 3 or 5% up to 30 or 40% by weight of the tablet or region thereof. The quantity may possibly be from 8% up to 20 or 25 or 30% or more. However, it is within this invention that the amount of such water-soluble disintegration-promoting particles is low, below 5% of the tablet or region, reliance being placed on insoluble swellable particles.

One possibility is that these particles contain at least 40% of their own weight, better at least 50%, of a material which has a solubility in deionised water at 20° C. of at least 50 grams per 100 grams of water.

These particles may provide material of such solubility in an amount which is at least 7 wt % or 12 wt % of the composition of the tablet or discrete region thereof. A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 40% by weight of these particles. A preferred material is sodium acetate in a partially or fully hydrated form.

It may be preferred that the highly water-soluble material is a salt which dissolves in water in an ionised form. As such a salt dissolves it leads to a transient local increase in ionic strength which can assist disintegration of the tablet by preventing nonionic surfactant from swelling and inhibiting dissolution of other materials.

Another possibility is that the said particles which promote disintegration are particles containing sodium tripolyphosphate with more than 40% (by weight of the particles) of the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 50% or 55% by weight of the tripolyphosphate in the particles.

Suitable material is commercially available. Suppliers include Rhone-Poulenc, France and Albright & Wilson, UK.

Another possibility is that the particles which promote disintegration are particles which contain at least 40 wt % sodium tripolyphosphate which is partially hydrated. The extent of hydration should be at least 0.5% by weight of the sodium tripolyphosphate in the particles. It may lie in a range from 0.5 to 4%, or it may be higher. Indeed fully hydrated sodium tripolyphosphate may be used to provide these particles.

It is possible that the particles contain at least 40 wt % sodium tripolyphosphate which has a high phase I content but is also sufficiently hydrated so as to contain at least 0.5% water by weight of the sodium tripolyphosphate.

The remainder of the tablet composition used to form the tablet or region thereof may include additional sodium tripolyphosphate. This may be in any form, including sodium tripolyphosphate with a high content of the anhydrous phase II form.

Other Detergent Ingredients

Tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N. V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included if organic surfactant is present, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a tablet of the invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets. A composition for fabric washing will generally not contain more than 15 wt % silicate. A tablet for machine dishwashing will frequently contain at least 20 wt % silicate.

Further ingredients which can optionally be employed in fabric washing detergent tablets of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A tablet of this invention, or a discrete region of such a tablet, is a matrix of compacted particles.

Preferably the particulate composition has an average particle size in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

While the starting particulate composition may in principle have any bulk density, the present invention may be especially relevant to tablets of detergent composition made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and possibly at least 600 g/liter.

A composition which is compacted into a tablet or tablet region may contain particles which have been prepared by spray-drying or granulation and which contain a mixture of ingredients. Such particles may contain organic detergent surfactant and some or all of the water-softening agent (detergency builder) which is also present in a detergent tablet.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Preferably, separate particles of the water-insoluble, water-swellable disintegration-promoting material required for this invention, and any optional water-soluble particles to promote disintegration, are mixed with the remainder of the particulate composition prior to compaction.

Product Forms and Proportions

The present invention may especially be embodied as a tablet for fabric washing will generally contain, overall, from 5 to 50% by weight of surfactant and from 5 to 80% by weight of detergency builder which is a water softening agent. Water-soluble disintegration promoting particles may be present in an amount from 5% to 25% by weight of the composition. Peroxygen bleach may be present and if so is likely to be in an amount not exceeding 25% by weight of the total composition.

A homogenous tablet, or any region of a heterogenous tablet which contains water-swellable material in accordance with this invention will generally contain it in an amount from 0.1 to 20% preferably not over 8% or 10% by weight of the tablet or by weight of that region. An amount which is specifically envisaged is in the range from 2 to 6% by weight.

In the case of a heterogenous tablet, a region which contains water-swellable material in accordance with this invention may also contain surfactant in an amount which is from 5 to 50% by weight of that region and detergency builder in an amount which is from 5 to 80% by weight of that region.

The invention may be embodied as tablets whose principal or sole function is that of removing water hardness. In such tablets the water-softening agents, especially water-insoluble aluminosilicate, may provide from 50 to 98% of the tablet composition. A water-soluble supplementary builder may well be included, for instance in an amount from 2% to 30wt % of the composition, or may be considered unnecessary and not used.

Water-softening tablets embodying this invention may include some surfactant.

The invention may be embodied as tablets for machine dishwashing. Such tablets typically contain a high proportion of water soluble salts, such as 50 to 95% by weight, at least some of which, exemplified by sodium citrate and sodium silicate, have water-softening properties.

Both water-softening and machine dishwashing tablets may include nonionic surfactant which can act as a lubricant during tablet manufacture and as a low foaming detergent during use. The amount may be small, e.g. from 0.2 or 0.5% by weight of the composition up to 3% or 5% by weight.

Tablets for use as a bleaching additive will typically contain a high proportion of peroxygen bleach, such as 25 to 85% by weight of the composition. This may be mixed with other soluble salt as a diluent. The composition of such a tablet may well include a bleach activator such as tetraacetylethylene diamine (TAED). A likely amount would lie in the range from 1 to 20% by weight of the composition.

In the case of tablets for bleaching, machine dishwashing or water-softening, just as mentioned above in the case of detergent tablets for fabric washing, a homogenous tablet, or any region of a heterogenous tablet which contains water-swellable material in accordance with this invention, will generally contain it in an amount from 0.1 to 10% preferably not over 8% by weight of the tablet or by weight of that region. Such a tablet or region may contain surfactant in small amount, such as from 0.2 to 3% or 5% by weight as mentioned above.

A composition which is to be compacted into a tablet or tablet region can be prepared by mixing the water-insoluble, water-swellable disintegration-promoting material, and any other particulate ingredients. Notably, these may include water-soluble Particles to promote disintegration. The materials may then be compacted which may suitably occur by compacting a quantity of the particulate composition in a mould so that it forms a tablet or region of a tablet.

Tableting

Tableting entails compaction of a particulate composition. A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet for fabric washing preferably lies in a range from 1040 or 1050 gm/liter preferably at least 1100 gm/liter up to 1400 gm/liter. The tablet density may well lie in a range up to no more than 1350 or even 1250 gm/liter. The overall density of a tablet of some other cleaning composition, such as a tablet for machine dishwashing or as a bleaching additive, may range up to 1700 gm/liter and will often lie in a range from 1300 to 1550 gm/liter.

EXAMPLES 1 TO 4

A detergent base powder, incorporating organic surfactants, a small percentage of crystalline sodium acetate trihydrate, and zeolite MAP detergency builder was made using known granulation technology. It had the following composition, which is shown both as weight percentages of the base powder and as parts by weight.

| Ingredient | % by Weight | Parts by Weight |
|---|---|---|
| Sodium linear alkylbenzene sulphonate | 23.65 | 11.12 |
| nonionic surfactant (C13–15 branched fatty alcohol 7EO) | 7.10 | 3.34 |
| Soap | 1.25 | 0.59 |
| zeolite A24 | 45.82 | 21.54 |
| Sodium acetate trihydrate | 6.17 | 2.90 |
| Sodium carbonate | 6.63 | 3.12 |
| sodium carboxymethyl cellulose (SCMC) | 0.96 | 0.45 |
| Sodium sulphate, moisture and minor ingredients including soil-release polymer | 8.42 | 3.96 |
| Total | 100 | 47.00 |

The amount of zeolite MAP (zeolite A24) in the table above is the amount which would be present if it was anhydrous. Its accompanying small content of moisture is included as part of the moisture and minor ingredients. Sodium carboxymethyl cellulose is a commonly used water-soluble antiredeposition polymer.

Coconut husk material was obtained as the residue after removal of fibres. It was observed to consist of particles which were mostly smaller than 2 mm, and contained some contaminants such as fragments of bark, larger than 2 mm.

The husk material was supplied in the form of compacted bricks. These were broken up by hand into small lumps which were further broken up and milled to powder in a kitchen blender. It was then sieved to remove any particles larger than 2,000 micrometers.

The resulting material had a mean particle size of 660 micrometers and a Rosin-Rammler "n" value of 1.65.

Its particle size distribution was

| Sieve traction | Percent by weight |
|---|---|
| <125 micrometers | 4.9% |
| 125–180 micrometers | 5.7% |
| 180–710 micrometers | 57.5% |
| 710–1,400 micrometers | 27.2% |
| 1,400–2,000 micrometers | 4.6% |

The base powder, the coconut husk material and other ingredients were mixed together as set out in the table below. The resulting compositions were compacted into single layer (i.e. homogenous) cylindrical tablets of weight 40 g using a Carver laboratory scale press and a 44 mm diameter die.

The tablets were made with two magnitudes of applied compaction force.

The strength of the tablets, in their dry state as made on the press, was determined as the force needed to break the tablet, measured using an Instron type universal testing instrument to apply compressive force on a tablet diameter (i.e. perpendicular to the axis of a cylindrical tablet). The applied force F was progressively increased until the tablet breaks, whereupon the force at failure $F_f$ in Newtons was recorded.

Tablet disintegration was determined by means of a test in which a tablet of known dry weight resting on a fine metal gauze was placed in a large volume of demineralised water at 20° C. The water was not agitated. After 1 minute the residue on the gauze was removed from the water and weighed.

This residue consisted of the portion of the tablet which had not dissolved or disintegrated, plus water which it had absorbed.

The weight of the residue was expressed as a percentage of the original tablet weight. If a tablet disintegrated well in this test where the water was not agitated, the percentage residue will be small. If a tablet absorbed water but did not disintegrate, the percentage residue may be over 100%.

The tablet compositions and the results obtained are set out in the following table:

| Example No | 1a % | 1b % | 2a % | 2b % | 3a % | 3b % | 4a % | 4b % | 4c % |
|---|---|---|---|---|---|---|---|---|---|
| Base powder, as above | 47.0 | 47.0 | 47.0 | 47.0 | 47.0 | 47.0 | 47.0 | 47.0 | 56.5 |
| Antifoam granules | 2.70 | 2.70 | 2.70 | 2.70 | 2.70 | 2.70 | 2.70 | 2.70 | 3.25 |
| Fluorescer on sodium carbonate | 2.70 | 2.70 | 2.70 | 2.70 | 2.70 | 2.70 | 2.70 | 2.70 | 3.25 |
| Soil release polymer (18% active) | 1.00 | 1.00 | 1.00 | 1.00 | 1.00 | 1.00 | 1.00 | 1.00 | 1.20 |
| sodium acetate trihydrate | 21.0 | nil | 20.0 | nil | 18.5 | nil | 16.0 | nil | nil |
| Sodium carbonate | nil | 21.0 | nil | 20.0 | nil | 18.5 | nil | 16.0 | nil |
| Coconut husk material, as above | nil | nil | 1.00 | 1.00 | 2.50 | 2.50 | 5.00 | 5.00 | 5.00 |
| Acrylate-maleate copolymer | 1.20 | 1.20 | 1.20 | 1.20 | 1.20 | 1.20 | 1.20 | 1.20 | 1.45 |
| Na-silicate (granular) 80% | 3.00 | 3.00 | 3.00 | 3.00 | 3.00 | 3.00 | 3.00 | 3.00 | 3.60 |
| TAED granules (83% active) | 4.00 | 4.00 | 4.00 | 4.00 | 4.00 | 4.00 | 4.00 | 4.00 | 5.00 |
| Percarbonate (coated) | 15.0 | 15.0 | 15.0 | 15.0 | 15.0 | 15.0 | 15.0 | 15.0 | 18.0 |
| Sequestrant granules (Dequest 2047) | 0.74 | 0.74 | 0.74 | 0.74 | 0.74 | 0.74 | 0.74 | 0.74 | 0.88 |
| Protease (Savinase 12.0TX) | 1.20 | 1.20 | 1.20 | 1.20 | 1.20 | 1.20 | 1.20 | 1.20 | 1.43 |
| perfume | 0.45 | 0.45 | 0.45 | 0.45 | 0.45 | 0.45 | 0.45 | 0.45 | 0.45 |
| Percent residue for tablets made to have $F_f$ = 40N | 88 | 117 | 67 | 96 | 23 | 60 | 8 | 3 | 6 |
| Percent residue for tablets made to have $F_f$ = 60N | 107 | 108 | 71 | 81 | 50 | 51 | 30 | 7 | 11 |

Although these results include some evident experimental variation, the efficacy of the water-swellable disintegrant particles is apparent, since tablets containing 1% of it disintegrate better than the tablets with none, especially when sodium acetate is present among the ingredients added to the base powder.

Tablets with 2.5% or 5% of the swellable coconut husk particles disintegrate even better.

EXAMPLE 5

A different batch of coconut husk material was sieved to provide four sieve fractions. Each fraction was then used to make tablets with the formulation given as example 3a above, and using the same procedure to produce tablets with a with a force at fracture of 40 kN. The tablets were tested as above. The particle size ranges and the residue results are set out in the following table:

| Coconut husk material: sieve fraction (micrometers) | residue percentage |
|---|---|
| 1,400–2,000 | 13 |
| 1,000–1,400 | 12 |
| 710–1,000 | 0 (ie no residue) |
| 500–710 | 11 |

EXAMPLE 6

A machine dishwashing composition was prepared by mixing together the following constituents.

| Ingredient | % by Weight |
|---|---|
| Sodium disilicate | 16.3 |
| Sodium carbonate | 28.8 |
| Sodium citrate dihydrate | 29.6 |
| Nonionic surfactant (C13–15 branched fatty alcohol 7EO) | 1.2 |
| Sodium perborate | 11.2 |
| TAED granules (83% active) | 3.8 |
| Enzymes | 3.2 |
| Polymer sequestrant and minor ingredients | 5.9 |
| Total | 100 |

Coconut husk material was prepared as in Example 1 and mixed into portions of the above composition in quantities of 2% and 4% by weight.

The resulting mixtures, as well as some of the compositions without coconut husk material, were compacted into single layer (i.e. homogenous) cylindrical tablets of weight 25 g using a Carver laboratory scale press and a 36 mm diameter die. The tablets were compacted with sufficient force to give a breaking strength (i.e. force at failure) of 80 Newtons.

They were tested, as in Examples 1 to 4, for speed of disintegration. The results were:

| % of coconut husk particles | residue |
|---|---|
| 0% | 112% |
| 2% | 53% |
| 4% | 2% |

What is claimed is:

1. A tablet of compacted particulate cleaning composition containing at least one cleaning ingredient which is an organic surfactant, a water softening agent or a bleach, wherein the tablet or a discrete region of the tablet contains water-insoluble, water-swellable disintegration-promoting particles which comprise both cellulose and lignin and are from a plant source other than timber.

2. A tablet according to claim 1 wherein the water-swellable disintegration-promoting particles contain at least 35% by weight lignin.

3. A tablet of compacted particulate cleaning composition containing at least one cleaning ingredient which is an organic surfactant, a water softening agent or a bleach, wherein the tablet or a discrete region of the tablet contains disintegration-promoting particles of coconut husk.

4. A tablet according to claim 1 wherein the disintegration-promoting particles have a mean particle size in a range from 250 to 1,500 micrometers.

5. A tablet according to claim 1 wherein the disintegration-promoting particles have a mean particle size in a range from 700 to 1,100 micrometers.

6. A tablet according to claim 1 containing overall from 5 to 50% by weight of surfactant and from 5 to 80% by weight of water-softening agent.

7. A tablet according to claim 1 wherein the tablet or discrete region thereof contains from 5 to 50% by weight of surfactant, from 5 to 80% by weight of water-softening agent and from 0.1 to 20% by weight of said water-swellable disintegration-promoting particles.

8. A tablet according to claim 1 wherein the tablet or a discrete region thereof contains from 0 to 5% by weight of surfactant, from 0.1 to 20% by weight of said water-swellable disintegration-promoting particles and either from 50 to 98% by weight of water-softening agent or from 25 to 85% by weight of a bleach.

9. A tablet according to either claim 1 or claim 3 which also contains water-soluble disintegration-promoting particles containing at least 40% by weight of the particles of one or more materials selected from the group consisting of compounds with water-solubility exceeding 50 grams per 100 grams water, phase I sodium tripolyphosphate, and sodium tripolyphosphate which is partially hydrated so as to contain water of hydration in an amount which is at least 0.5% by weight of the sodium tripolyphosphate in the particles.

10. A tablet according to claim 9 wherein the disintegration-promoting particles contain at least 40% by weight of the particles of compounds selected from the group consisting of urea, salts with a water-solubility exceeding 50 gm per 100 gms water, and mixtures thereof.

11. A tablet according to claim 9 wherein said disintegration-promoting particles in the tablet or region thereof contain at least 40% by weight of the particles of phase I sodium tripolyphosphate which is partially hydrated so as to contain water of hydration in a range from 0.5 to 4% by weight of these particles.

12. A tablet according to claim 9, wherein the tablet or said discrete region thereof contains from 8 to 25 wt % of said water-soluble disintegration-promoting particles.

13. A tablet according to claim 1 wherein the tablet or region thereof comprises water-insoluble detergency builder in an amount from 5 to 98% by weight of the tablet or said region thereof.

14. A tablet according to claim 1, which tablet contains a plurality of discrete regions at least one of which contains a greater concentration of the said water-insoluble water-swellable disintegration-promoting particles than another region of the tablet.

15. A tablet according to claim 1 overall contains 5 to 98 wt % water-insoluble detergency builder.

16. A tablet according to claim 1 which overall contains from 10 to 80% by weight of water-soluble detergency builder.

17. A tablet according to claim 1 which overall contains 8 to 40% by weight of surfactant.

18. Process for making a tablet as claimed in claim 1 which comprises mixing water-insoluble, water-swellable disintegration-promoting material with the surfactant and either the water-softening agent or the bleach so as to form a particulate cleaning composition and compacting a quantity of the particulate composition in a mould so that it forms a tablet or a region of a tablet.

* * * * *